US010683873B1

(12) United States Patent
Demski

(10) Patent No.: US 10,683,873 B1
(45) Date of Patent: Jun. 16, 2020

(54) MULTIPLE CHANNEL DIFFUSER

(71) Applicant: P3 Technologies, LLC, Jupiter, FL (US)

(72) Inventor: Brandon A Demski, Jupiter, FL (US)

(73) Assignee: P3 Technologies, LLC, Jupiter, FL (US)

( * ) Notice: Subject to any disclaimer, the term of this patent is extended or adjusted under 35 U.S.C. 154(b) by 80 days.

(21) Appl. No.: 15/812,103

(22) Filed: Nov. 14, 2017

(51) Int. Cl.
*F04D 29/44* (2006.01)
*F04D 1/06* (2006.01)
*F04D 29/66* (2006.01)

(52) U.S. Cl.
CPC ..... *F04D 29/44* (2013.01); *F04D 1/063* (2013.01); *F04D 29/441* (2013.01); *F04D 29/445* (2013.01); *F04D 29/669* (2013.01)

(58) Field of Classification Search
CPC ..... F04D 29/445; F04D 29/448
See application file for complete search history.

(56) References Cited

U.S. PATENT DOCUMENTS 297,310 A * 4/1884 Studley ..... F04D 1/006 415/98
3,374,831 A * 3/1968 Sieverding ..... F04D 29/441 165/122
5,025,629 A * 6/1991 Woollenweber ..... F01D 17/141 415/160
6,905,535 B2 * 6/2005 Keefer ..... B01D 53/047 95/101
7,179,048 B2 * 2/2007 Huang ..... F04D 29/4206 415/126
8,147,186 B2 * 4/2012 Ibaraki ..... F04D 29/4206 415/148

* cited by examiner

*Primary Examiner* — Igor Kershteyn
*Assistant Examiner* — Juan G Flores
(74) *Attorney, Agent, or Firm* — John Ryznic

(57) ABSTRACT

A multiple channel diffuser having an annular shaped radial inlet and a tangential outlet, and a plurality of separated diffuser channels connecting the radial inlet to the tangential outlet such that a flow does not mix. A tap-off passage can be used to provide flow to a gas generator or a preburner. A cross-over passage can also be used to provide flow from a first diffuser to a second diffuser.

4 Claims, 6 Drawing Sheets

Vane Island Diffuser

Airfoil Diffuser

Vaneless Diffuser

MULTIPLE CHANNEL DIFFUSER

CROSS-REFERENCE TO RELATED APPLICATIONS

None.

GOVERNMENT LICENSE RIGHTS

None.

BACKGROUND OF THE INVENTION

Field of the Invention

The present invention relates generally to a pump or compressor, and more specifically to a diffuser for a pump or compressor.

Description of the Related Art Including Information Disclosed Under 37 CFR 1.97 and 1.98

A pump or a compressor such as a Turbopump uses a diffuser to convert the dynamic pressure exiting the pump or compressor into static pressure rise at the volute exit. There are three commonly used diffusers: vaneless diffusers, airfoil diffusers, and vane island diffusers. FIG. 10 shows a vane island diffuser. FIG. 11 shows an airfoil diffuser. FIG. 12 shows a vaneless diffuser. The single greatest loss in a turbopump is in the diffuser. The diffuser losses account for more than 20% of the total pressure loss from the impeller discharge to the volute. The losses are from the leading edge (incidence loss), the trailing edge (expansion loss), mixing losses, and skin friction losses. Of these losses, the mixing loss is the greatest and is responsible for more than 90% of the total loss.

The mixing loss is the greatest because of the large pressure and velocity gradient between the diffuser and the volute. An additional contributor to the loss is the asymmetry caused by the volute tongue. The volute tongue also causes a circumferential static pressure gradient around the volute that propagates through the diffuser to the impeller, and is the primary contributor to the radial side load from the impeller to be reacted by the bearings. Eliminating the tongue, and this circumferential pressure gradient, eliminates this side load, which increases bearing life and reliability.

Additionally, the radial component of the kinetic energy is nearly unrecoverable once it enters the volute, along with the meridional dynamic pressure. These losses are virtually eliminated with the Multiple Channel Diffuser (MCD) of the present invention. Leading edge or incidence loss is due to the stagnation condition caused by leading edge and any misalignment between the flow field stream lines and the leading edge. Even if these are perfectly aligned at design point conditions (which is not possible), incidence losses occur at off-design conditions. Trailing edge losses result from pressure gradients between the pressure and suction side of the diffuser. These losses exist even in symmetric vanes, but are greater in non-symmetric vanes with turning due to the increased pressure and velocity gradients between the pressure and suction sides. The Multiple Channel Diffuser of the present invention eliminates these losses. Skin friction losses are due to the velocity of the moving fluid in contact with a stationary wall. These losses can be significant in pumps with viscous fluid; however, they are negligible for cryogens such as hydrogen, oxygen, and methane, as these are nearly inviscid. Even non-cryogens with low viscosity such as RP or any low-viscosity fluid such as water would have relatively low skin friction losses. To highlight the magnitude of the mixing losses, note than the vaneless diffuser does not have leading edge or trailing edge losses, yet is the least efficient diffuser because of its higher mixing losses.

BRIEF SUMMARY OF THE INVENTION

The Multiple Channel Diffuser of the present invention eliminates mixing losses, resulting in a significant increase in pressure recovery (such as around 20% or greater). The impeller discharge pressure is expanded gradually and efficiently in discrete passages. Once the flow has been fully expanded, it is merged and combined with adjacent passages. However, because the flow is fully expanded (and because there is no turning), there are no significant pressure or velocity gradients to cause mixing losses. Holding the pump or compressor, engine size, and stage constant, this results is a significant increase in chamber pressure for additional stage capability (higher orbits, higher orbit inclinations, and/or heavier payloads). Alternatively, holding the specific impulse and thrust constant, both the maximum diameter and overall length shrink significantly, resulting in a smaller, lower weight stage with a significant increase in mission capability.

In one embodiment, the multiple channel diffuser includes an annular radial inlet with a plurality of separate passages that form parallel passages each with a continuous expansion with a tangential outlet. The passages are circular in cross sectional shape.

In a second embodiment, the multiple channel diffuser is a conical diffuser with square or diamond or trapezoid or rectangular cross sectional shapes.

In a third embodiment, the multiple channel diffuser includes one or more passages in a Tap-Off configuration to provide flow to another device such as a gas generator or a pre-burner impeller without incurring the additional inlet, mixing, and discharge losses associated with a Tap-Off.

In a fourth embodiment, the multiple channel diffuser includes a passage to be used as an internal or external cross-over in multiple stage pumps or pumps with a pre-burner impeller where only a portion of the flow is re-routed.

DETAILED DESCRIPTION OF THE INVENTION

Figure 1:
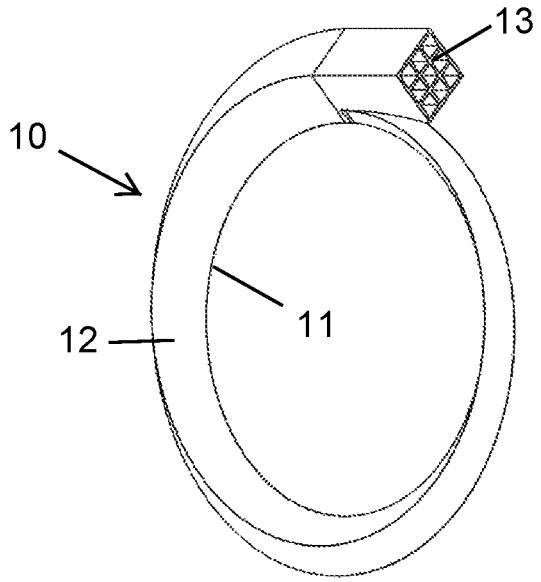
FIG. 1 shows a schematic view of the Multiple Channel Diffuser according to a first embodiment of the present invention.

The present invention is a Multiple Channel Diffuser (MCD) for a pump or a compressor such as a turbopump with an annular shaped radial inlet and a tangential outlet where the multiple passages are separate from one another in order to limit mixing of the fluid. FIG. 1 shows one such embodiment of the MCD 10 with an outlet having a square cross section shape with nine separate passages. The MCD includes an annular shaped radial inlets 11 in which each inlet 11 is connected to a separate passage 12 that leads to a common outlet 13. The separate passages 12 each have a gradually increasing cross sectional area from the inlet to the outlet to produce individual diffusers without mixing of fluids. An impeller discharges a fluid outward in an annular arrangement and into the separate radial inlets of the MCD 10. Each inlet 11 is connected to its own separate passage 12 and opens into a common outlet 13. The impeller rotates within the stationary MCD.

Figure 2:
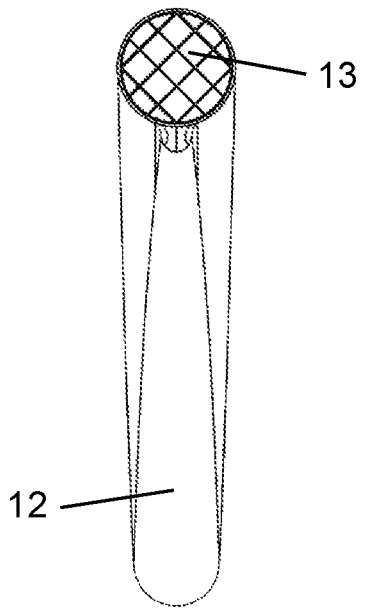
FIG. 2 shows a front view of the Multiple Channel Diffuser of the present invention with a circular shaped outlet.
Figure 3:
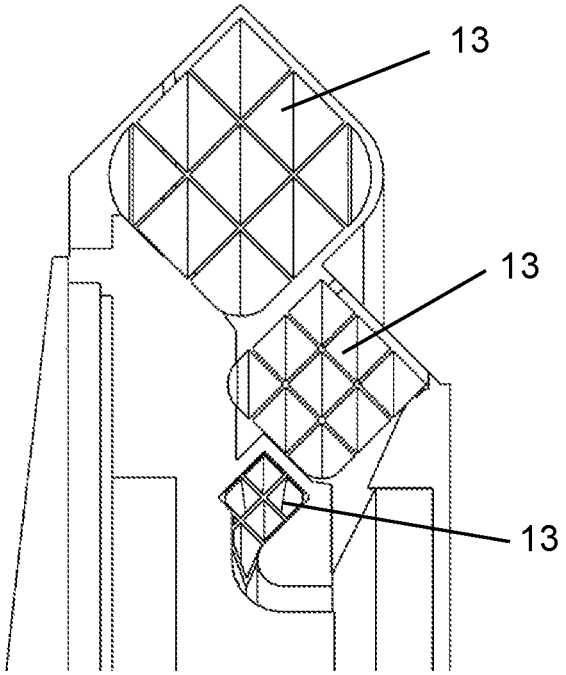
FIG. 3 shows a front view of the Multiple Channel Diffuser of the present invention with a main discharge and partial internal crossover and second stage discharge.

The MCD of the present invention can have an outlet with a square cross section shape as in the FIG. 1 embodiment, or a circular cross section shape as in the FIG. 2 embodiment. In the FIG. 3 embodiment of the MCD, the MCD has a main discharge with a partial internal crossover and a second stage discharge. The FIG. 1 embodiment of the MCD shows a radial inlet with a tangential outlet. However, the MCD can also work with an axial inlet and an outlet that is not tangential. For example, an axial flow pump or compressor can discharge a flow into an annular arrangement of axial inlets each having a passage separate from others that each discharge into a common outlet that is not tangential to the axis of the pump or compressor.

Figure 4:
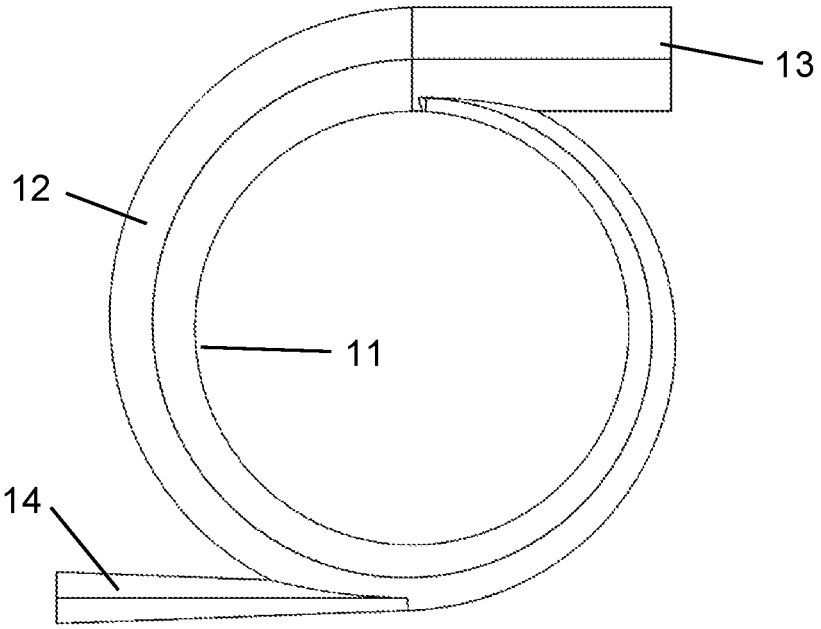
FIG. 4 shows a side view of the Multiple Channel Diffuser with one or more passages shown in a Tap-Off configuration of the present invention.

The MCD of the FIG. 4 embodiment has one or more passages shown in a Tap-Off 14 configuration. One or more of the separate channels 12 can discharge into the tap-off channel 14.

Figure 5:
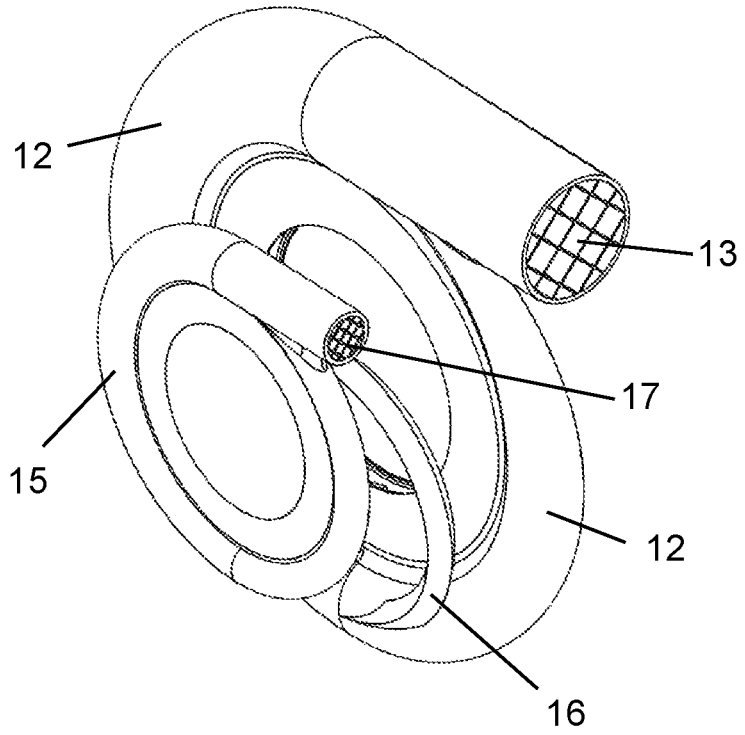
FIG. 5 shows a schematic view of the Multiple Channel Diffuser with one passage shown in a cross-over configuration to a preburner impeller of the present invention.

The MCD of the FIG. 5 embodiment has one passage shown in a cross-over configuration to a preburner impeller. The MCD 10 with inlets opening into the separate channels 12 flowing into a common outlet 13 in which one or more of the separate channels 12 can flow into a cross-over channel 16 and into a second multiple channel diffuser 15 with a second common outlet 17. The second MCD also has a plurality of separate diffuser channels 15.

Figure 6:
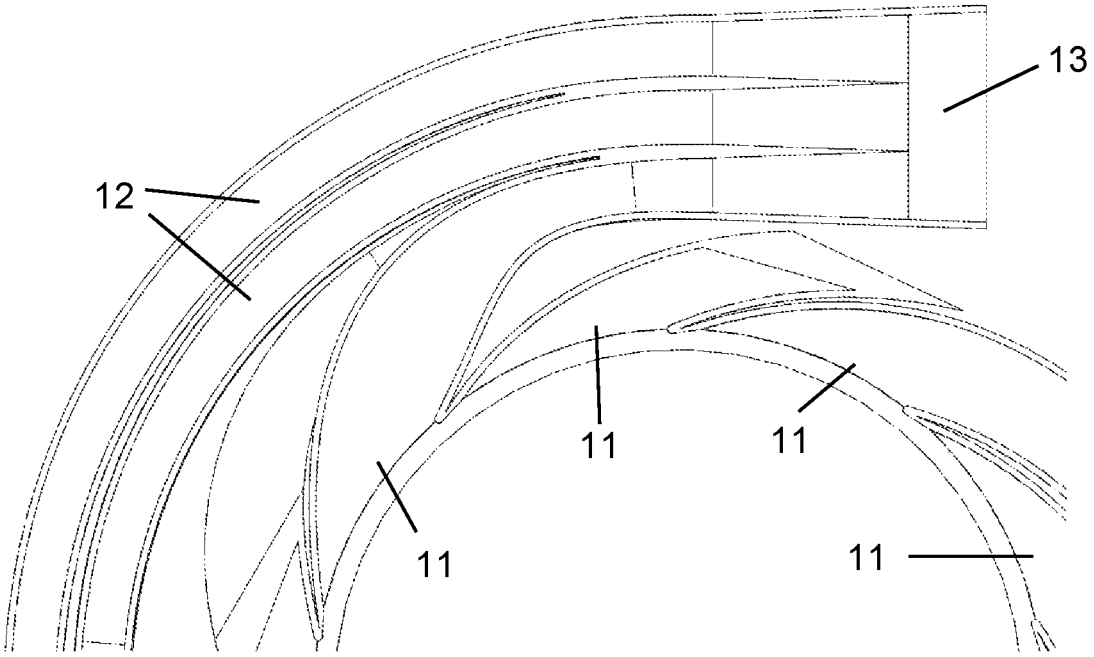
FIG. 6 shows a cross section side view of a section of the Multiple Channel Diffuser with inlet passages, separate channels and a common outlet of the present invention.
Figure 7:
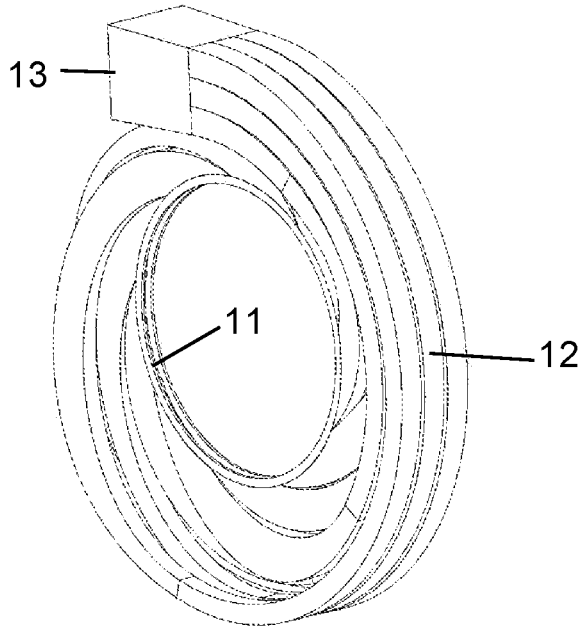
FIG. 7 shows a view from a back side of the Multiple Channel Diffuser of the present invention with square shaped outlet.
Figure 8:
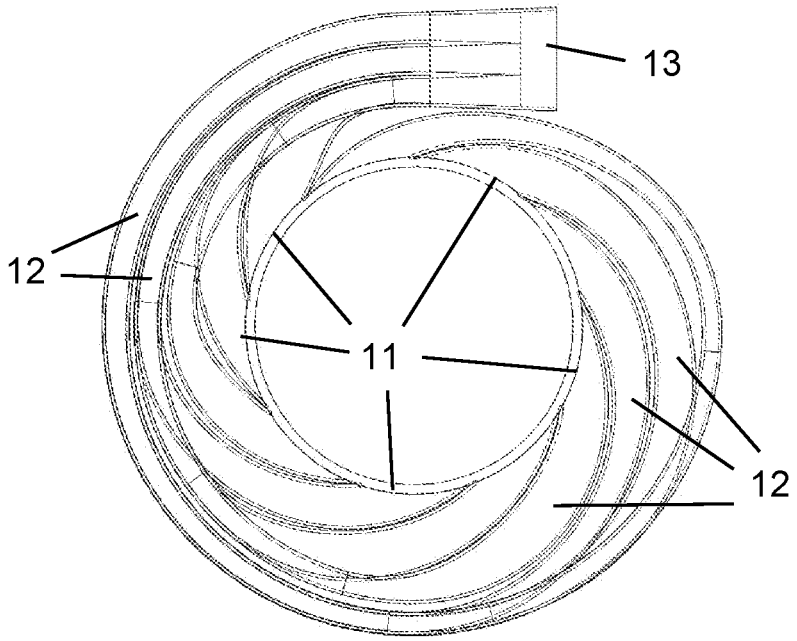
FIG. 8 shows a cross section side view of the Multiple Channel; Diffuser of FIG. 7.
Figure 9:
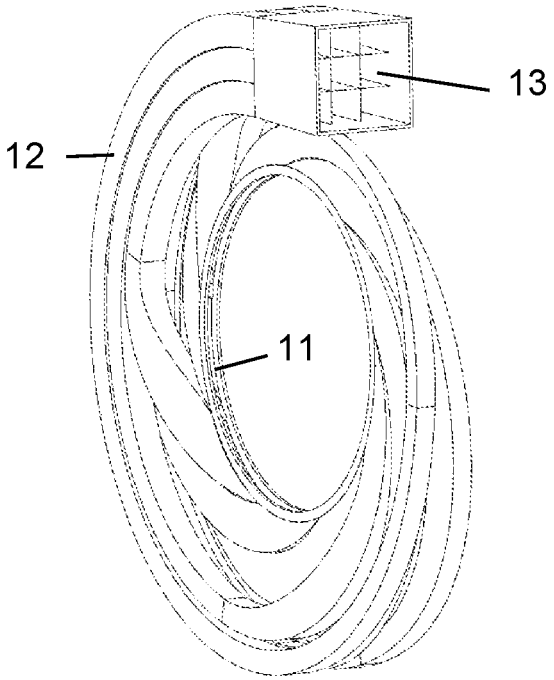
FIG. 9 shows a view from a front side of the Multiple Channel Diffuser of FIG. 7 with square shaped outlet.
Figure 10:
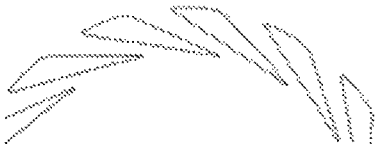
FIG 10 PRIOR ART
FIG. 10 shows a cross section view of a Vane Island Diffuser of the prior art.
Figure 11:
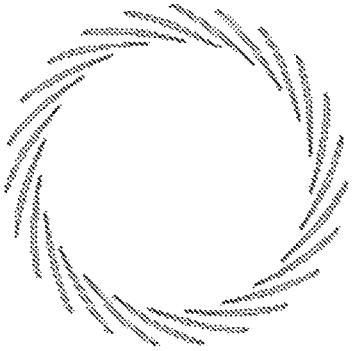
FIG 11 PRIOR ART
FIG. 11 shows a cross section view of an Airfoil Diffuser of the prior art.
Figure 12:
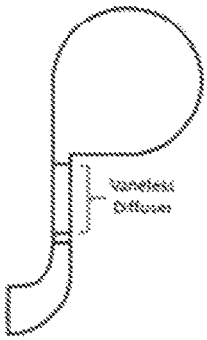
FIG 12 PRIOR ART
FIG. 12 shows a cross section view of a vaneless Diffuser of the prior art.

FIG. 6 shows a cross sectional view of a section of the MCD 10 with a number of inlets 11 each flowing into a separate channel 12, with the separate channels discharging into a common outlet 13. FIG. 7 shows a schematic view of the MCD from a back side with the common outlet 13 being square shaped. FIG. 8 shows a cross section side view of the MCD of FIG. 7 with nine inlets that flow into none separate channels 12. FIG. 9 shows a schematic view of the MCD from a front side with the square shaped common outlet 13 in which one can see the nine separate channels. This embodiment of the MCD shows nine channels, yet more or less separate channels and inlets can be used without departing from the spirit or scope of the present invention.

The MCD leading edge is similar to that of an airfoil diffuser, except that the passage is extended and continually expands the flow as it wraps around the impeller. Additionally, the leading edge of the MCD 10 is significantly thinner than the leading edge of an airfoil or vane island diffuser, which reduces the stagnation losses. The cross-section view in FIG. 8 illustrates how the passages are distributed internally to achieve the "matrix" arrangement shown in the side view of FIGS. 2 and 3. Unwrapped, the MCD is a conical diffuser of square, diamond, trapezoid, or rectangular cross section. The expansion angle is very small due to the length, which enables highly efficient diffusion with minimal loss. After the dynamic pressure has been diffused to static pressure rise, the passages are then joined in a reverse-splitter coalescing configuration resulting in a volute discharge that looks and functions identical to discharges used in the prior art diffusers. Since each channel is independent of one another, the unique channels can be bundled or separated and redirected for other purposes. And since they are independent passages, they can be packages in planar arrangements, rather than bundles, to enable packaging configurations never possible previously.

The use of the MCD enables additional capabilities not possible with prior art diffusers. In one example, a portion of the passages 14 could be re-routed to provide flow to a gas generator or a preburner impeller (FIG. 4 embodiment) without incurring the additional inlet, mixing, and discharge losses associated with a tap-off. The passages 15 can also be used as an internal or external cross-over in multiple stage pumps or pumps with a preburner impeller where only a portion of the flow is re-routed (FIG. 5 embodiment).

The Multiple Channel Diffuser eliminates mixing losses, resulting in a 20% or greater increase in pressure recovery. The impeller discharge dynamic pressure is expanded gradually and efficiently in discreet passages. Once the flow has been fully expanded, it is merged and combined with adjacent passages. However, because the flow is fully expanded (and because there is no turning), there are no significant pressure or velocity gradients to cause mixing losses. Holding the turbopump, engine size, and stage constant, this results in a 20% increase in chamber pressure for additional stage capability (higher orbits, higher orbit inclinations, and/or heavier payloads). Alternatively, holding specific impulse and thrust constant, both the maximum diameter and overall length shrink significantly, resulting in a smaller, lower weight stage with a significant increase in mission capability.

Diffusers and volutes typically have thick housings to contain the high pressure. A discharge pressure is the same regardless of diffuser or passage size. Therefore, the wall thickness is solely dependent on the passage size. A single large volute requires a thick wall. A small passage requires a thin wall. And the "thin wall" would only be required on exterior passages. Interior passages, those passages surrounded by other passages, have no pressure gradient on the wall due to the adjacent passage, and can be even thinner. As a result, additional weight savings (beyond the weight savings resulting from a smaller engine) are possible just from the diffuser and volute housings of the MCD.

I claim the following:

1. A multiple channel diffuser comprising:

an annular arrangement of a plurality of inlets;

an outlet;

a plurality of diffuser channels connecting the plurality of inlets to the outlet;

each of the diffuser channels having an increasing flow area;

each of the diffuser channels forming a separate diffuser channel from the inlet to the outlet such that a flow within the separated diffuser channels does not mix; and, the plurality of diffuser channels are formed as a plurality of rows with each row having a plurality of diffuser channels.

2. The multiple channel diffuser of claim 1, and further comprising:

the plurality of inlets are radial inlets.

3. The multiple channel diffuser of claim 1, and further comprising:

the outlet is a tangential outlet.

4. The multiple channel diffuser of claim 1, and further comprising:

the outlet has a square shaped cross section or a circular shaped cross section.

* * * * *